US006247213B1

(12) United States Patent
Uehara

(10) Patent No.: US 6,247,213 B1
(45) Date of Patent: Jun. 19, 2001

(54) BUCKLE

(75) Inventor: Ryoichiro Uehara, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/396,336

(22) Filed: Sep. 15, 1999

(30) Foreign Application Priority Data

Sep. 30, 1998 (JP) ..... 10-278602

(51) Int. Cl.[7] ..... A44B 11/26
(52) U.S. Cl. ..... 24/625; 24/265 BC
(58) Field of Search ..... 24/614–616, 625, 24/265 BC; D11/216, 218

(56) References Cited

U.S. PATENT DOCUMENTS

D. 341,105 * 11/1993 Lovato .
D. 373,747 * 9/1996 Anscher .
4,662,040 * 5/1987 Terrell et al. .
4,912,950 * 4/1990 Crowle .
5,131,122 * 7/1992 Lovato .
5,309,610 * 5/1994 le Gal .
5,507,076 * 4/1996 Anscher .
5,729,887 3/1998 Kong et al. .
6,076,237 * 6/2000 Goorhouse .

FOREIGN PATENT DOCUMENTS 0 648 441 A1 4/1995 (EP) .

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

A buckle body, flat cylindrical in shape, includes an upper plate, a lower plate and side walls. The buckle body has at its one end an insertion opening, and at its other end a belt-mounting part. Each of the opposite side walls has an opening to form engaged portions. A projection projecting from a central portion of the upper plate at the side of an insertion opening project above a belt passage of the insertion body. The insertion body has a belt-fastening portion, a belt-folding portion, the belt passage, and a base portion which are arranged from one end to an inner side thereof and extend between side frames. The base portion has at its opposite sides operating portions, which have at their intermediate portion engaging portions so as to engage/disengage from the buckle body. Even when the belt on the insertion body loosens while the buckle is used, the belt is prevented from loosening by the projection, and the length of the belt can be adjusted by obliquely lifting up the engaged buckle body. Therefore, at the time of engagement of the buckle, the fastening state of the belt can be checked visually, the length of the belt can easily be adjusted, and the belt is prevented from expanding and loosening excessively within the buckle.

6 Claims, 8 Drawing Sheets

BUCKLE

BACKGROUND OF THE INVENTION

1. Field of the Invention

The present invention relates to a buckle of an inserting type comprising female and male members, i.e., a buckle body and an insertion body. More particularly, it relates to a buckle for fastening a belt generally used for clothes, shoes, helmets, baby cars or sporting goods.

2. Description of the Related Art

A conventional buckle of this type comprising a buckle body and insertion body is formed into a flat cylindrical body as shown in FIG. 14, which is disclosed in U.S. Pat. No. 5,309,610. The buckle comprises the buckle body 1' having at its opposite side surfaces opening portions 8', and the insertion body 2' having at its one end a belt-mounting part having a belt-folding portion 22' and a belt-fastening portion 21' and a pair of flexible operating portions 25' projecting from opposite sides of the insertion body 2' extending from the belt-mounting part toward the other end. Each of the operating portions 25' has at its outer side surface an engaging portion 28' to be engaged with the opening portion 8' of the buckle body 1'. An upper plate 3' of the buckle body 1' is extended to provide an extending portion 30'. When the buckle body 1' and the insertion body 2' are engaged with each other, the belt B' is caught on the belt-folding portion 22', and then the extending portion 30' of the upper plate 3' of the buckle body 1' is brought into contact with an upper surface of the folded belt B' under pressure so as to prevent the belt B' from being loosened.

Further, Japanese Patent Laid-open No. 9-135709 discloses a buckle as shown in FIG. 15. This buckle comprises a buckle body 1" formed into a flat cylindrical shape and having at its opposite side surfaces opening portions 8", and an insertion body 2" having a belt-fastening portion 21", a belt-folding portion 22" with a step 22*a*" at its inner side, a base portion 23" on a further inner side thereof. The insertion body 2' further has a resilient projection 40" urged toward the step 22*a*" of the belt-folding portion 22", and a pair of operating portions 25" projecting from the base portion 23". Each of the operating portion 25" has at its outer side surface an engaging portion 28". The resilient projection 40" is urged toward the step 22*a*w and brought into resilient contact with the belt which is caught on the belt-folding portion 22" and folded, thereby fastening the belt under pressure so as to prevent the belt from being loosened.

In the case of the above-described buckle shown in FIG. 14, when the buckle body 1' and the insertion body 2' are engaged with each other, since the engaging state of the belt B' between the belt-folding portion 22' and the belt-fastening portion 21' can not be checked visually, it is not possible to smoothly adjust the length of the belt B' at the time of engagement of the buckle. Further, since the upper plate 3' of the buckle body 1' completely covers the belt-folding portion 22' and the belt-fastening portion 21' of the insertion body 2', and presses the belt B' caught on the belt-folding portion 22', the length of the belt can not be adjusted at the time of engagement.

In the case of the buckle shown in FIG. 15, when the buckle body 1" and the insertion body 2" are in engagement or out of engagement with each other, the resilient projection 40" must be inclined so as to be separated from the belt-folding portion 22" when the length of the belt is adjusted. Therefore, the adjusting operation is troublesome. Further, when the belt is mounted to the insertion body 2", since the resilient projection 40" must be always operated, the inserting operation of the belt is also troublesome. Furthermore, there is a problem that it is difficult to integrally mold the buckle because of the belt-folding portion 22" and the resilient projection 40" of the insertion body 2".

SUMMARY OF THE INVENTION

The present invention has been accomplished in view of the above problems, and has a main object to provide a buckle comprising a buckle body and an insertion body in which a belt is prevented from excessively swelling and loosening in the buckle when the buckle is used, the length of the belt can easily be adjusted even when the buckle body and the insertion body are engaged with each other, the belt can easily be adjusted while visually checking its fastening state, and the belt can easily be prevented from loosening with a simple structure.

Further, it is another object of the present invention to provide a buckle in which it is possible to prevent the belt from loosening and to easily adjust the length of the belt even when the belt used for the buckle is relatively thick or rigid.

Furthermore, it is another object of the present invention to provide a buckle capable of preventing the belt from loosening over the entire width of the buckle.

Still further, it is another object of the present invention to provide a buckle capable of preventing the belt from loosening more appropriately and efficiently.

Still further, it is another object of the present invention to provide a buckle whose engaging pattern between the buckle body and the insertion body is specified so that it is possible to prevent the belt from loosening and to easily adjust the length of the belt.

To achieve the above object, according to the present invention, there is provided a buckle comprising: a buckle body including an upper plate, a lower plate and both side walls, an insertion opening at one end of the buckle body, a belt-mounting part at the other end of the buckle body, opening portions at the side walls, and engaged portions; an insertion body including a belt-fastening portion at one end of the insertion body, a belt-folding portion on an inner side of the belt-fastening portion, a belt passage on an inner side of the belt-folding portion, and a base portion on an inner side of the belt passage, the insertion body further including flexible operating portions projecting from opposite sides of the base portion toward the belt-mounting part of the buckle body and having engaging portions, wherein the buckle body further includes a projection formed as an extension of the upper plate of the insertion opening so as to further project than the lower plate and to project above the belt passage of the insertion body at the time of engagement of the buckle body and the insertion body so that a belt wound around the belt-folding portion is prevented from loosening.

Further it is preferable that the projection formed on the upper plate of the buckle body is formed into an arc shape whose center portion projects most.

Alternatively, the projection formed on the upper plate of the buckle body may be formed so as to totally and uniformly project in parallel to an end of the lower plate.

Further preferably, the projection formed on the upper plate of the buckle body is formed so as to project toward a tip end edge of the belt-folding portion of the insertion body, i.e. further than the base portion of the insertion body, at the time of the engagement of the buckle.

Furthermore, it is preferable that the engaging portions are respectively formed on outer surfaces of the pair of operating portions projecting from the base portion of the insertion body, and the engaged portions to be engaged with the engaging portions of the insertion body are respectively formed on one-side ends, i.e. the ends towards the insertion opening, of the opening portions formed at the side walls of the buckle body, so that the buckle body and the insertion body can be engaged with/disengaged from each other.

Alternatively, the engaging portions may be respectively formed on upper and lower surfaces of tip ends of the pair of operating portions projecting from the base portion of the insertion body, and the engaged portions to be engaged with the engaging portions of the insertion body are respectively formed on inner or rear surfaces of the upper plate and the lower plate of the buckle body, so that the buckle body and the insertion body can be engaged with/disengaged from each other.

PREFERRED EMBODIMENTS OF THE INVENTION

Embodiments of a buckle of the present invention will be explained in detail with reference to the drawings below.

Figure 1:
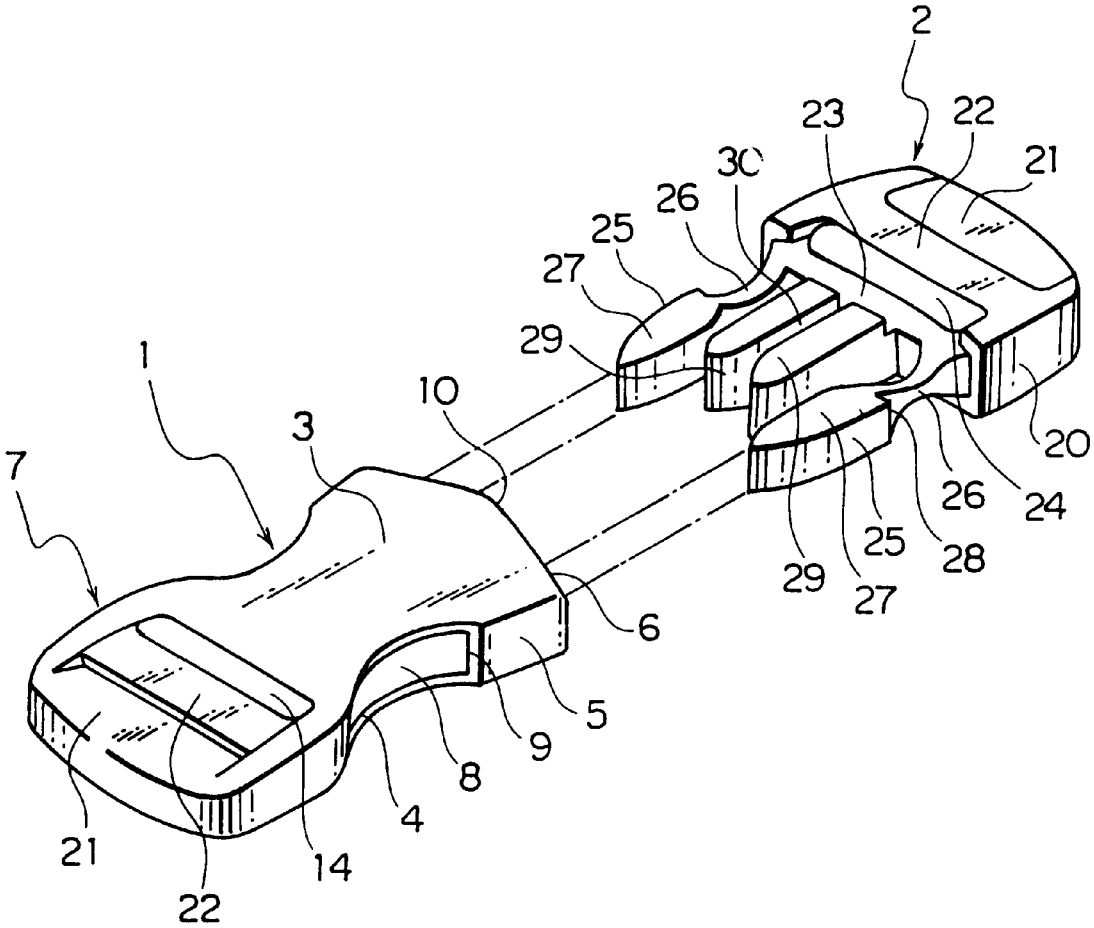
FIG. 1 is a perspective view of a buckle according to a first embodiment of the invention in a state in which a buckle body and an insertion body of the buckle are disengaged.

As shown in FIG. 1, a buckle of the invention comprises a buckle body 1 and an insertion body 2. The insertion body 2 is to be inserted into and removed from the buckle body 1. The buckle body 1 and the insertion body 2 are integrally molded by injection molding or extrusion molding, using thermoplastic resin such as polyacetal, polyamide, polypropylene and polybutylene terephtalate.

The buckle according to a first embodiment of the invention as shown in FIGS. 1 to 7 is flat cylindrical in shape, and the buckle body 1 comprises an upper plate 3, a lower plate 4 and side walls 5. The buckle body 1 has at its one end an insertion opening 6, and at its other end a belt-mounting part 7. Each of the opposite side walls 5 has an opening portion 8 which is cut in arc shape. The opening portion 8 has, at its side closer to the insertion opening 6, an engaged portion 9 to be engaged with an engaging portion 28 of a flexible operating portion 25 which will be described later. A distance between both the side walls 5 is formed such that the distance at a side of the insertion opening 6 is wider and the distance at a side of the opening portion 8 is narrower. Therefore, if the operating portions 25 of the insertion body 2 are pushed at the time of engagement, the insertion body 2 can be detached from the buckle body 1 automatically.

Figure 2:
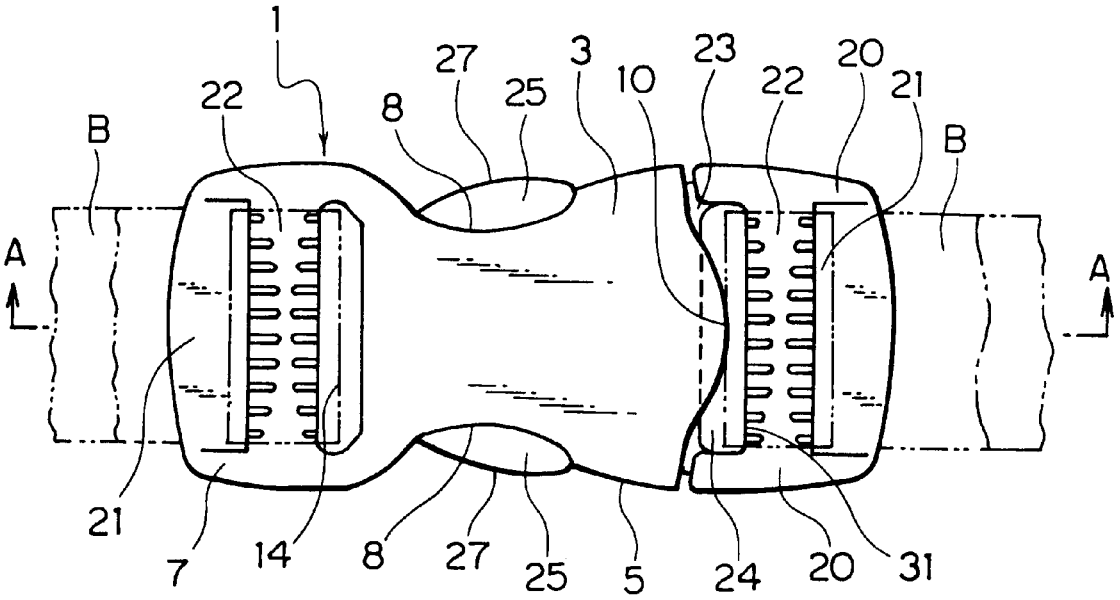
FIG. 2 is a plan view showing an engaged state of the buckle body an the insertion body of the buckle.

The upper plate 3 has, at a side of the insertion opening 6, an arc projection 10 whose center portion projects most. When the insertion body 2 is inserted in and engaged with the buckle body 1, as shown in FIG. 2, the projection 10 extends above a belt passage 24 between a belt-folding portion 22 and a base portion 23 of the insertion body 2, and projects toward a tip end edge 31 of the belt-folding portion 22 so as to restrain the belt B from loosening and swelling.

Figure 3:
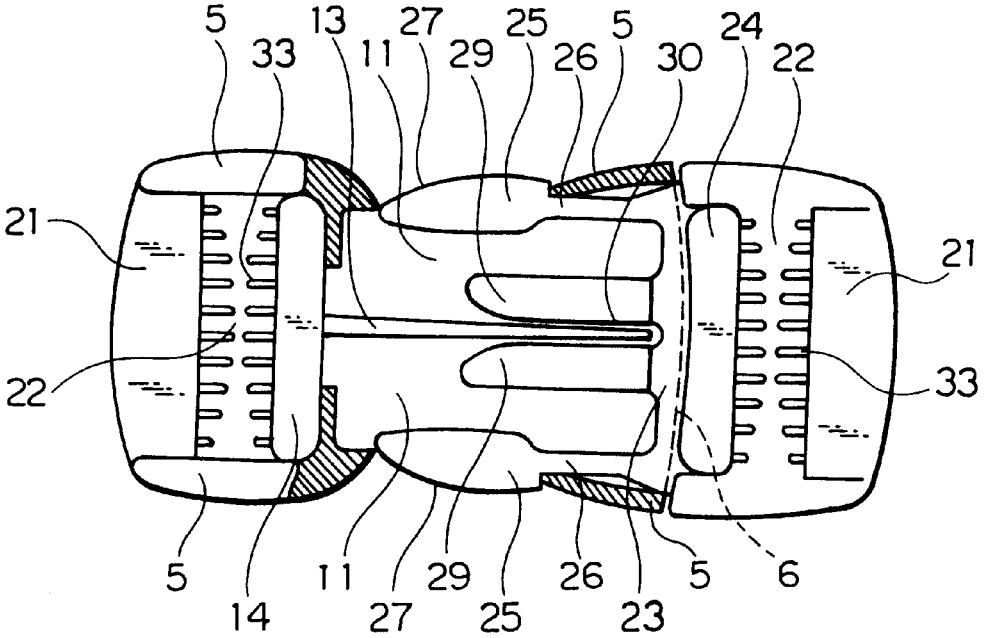
FIG. 3 is a plan view of the buckle when the buckle body and the insertion body of the buckle are engaged with each other, with the buckle body partly cut away.
Figure 4:
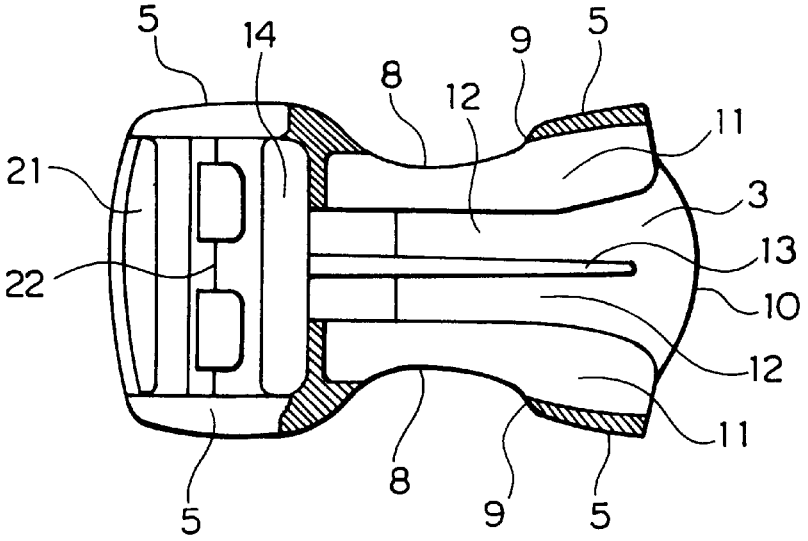
FIG. 4 is a rear view of the buckle in which a part of the buckle body is cut away.

As shown in FIGS. 3 and 4, the buckle body 1 has a ridge portions 13 respectively protruding from center portions of inner surfaces of the upper plate 3 and the lower plate 4 and confronting with each other. A portion of each ridge portion 13 closer to the insertion opening 6 is fitted into a fit groove 30 formed between a pair of projecting pieces 29 projecting from the base portion 23 of the insertion body 2. The lower plate 4 has a flat inner surface on the opposite sides of the ridge portion 13 such that the projection pieces 29 and the operating portions 25 can slide and swing thereon. The inner surface of the upper plate 3 is slightly different from that of the lower plate 4. As shown in FIG. 4, the ridge portion 13 has on its opposite sides deeply recessed grooves 12 for guiding the projection pieces 29. The recessed grooves 12 have on their respective opposite sides hollow portions 11 shallower than the recessed grooves 12, such that the operating portions 25 can slide and swing thereon.

Figure 5:
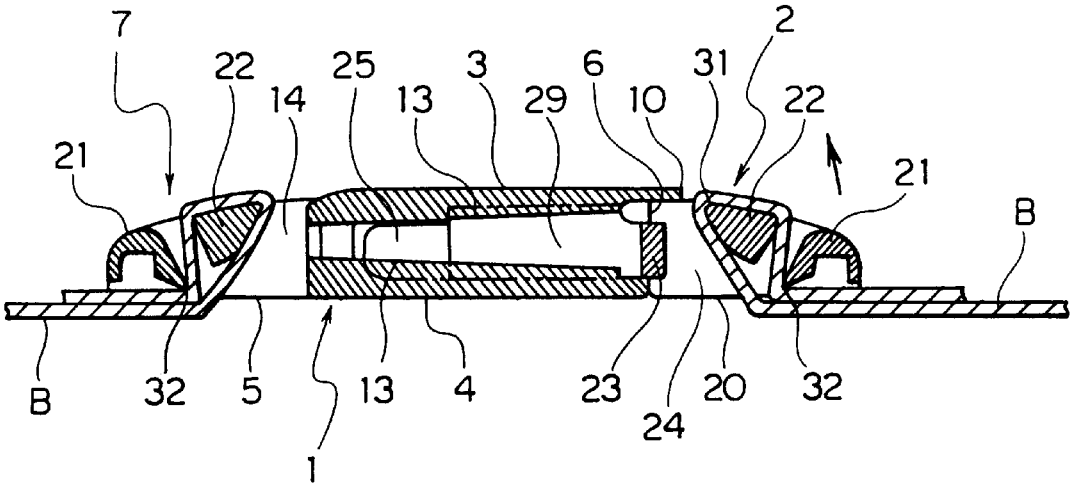
FIG. 5 is a sectional view of the buckle taken along the line A—A in FIG. 2.

As shown in FIG. 5, in the belt-mounting part 7 provided at one end of the buckle body 1, a belt-fastening portion 21 having a reversed bucket-like cross section and a belt-folding portion 22 having a reversed triangle cross section and extending between the side walls 5 of the buckle body 1 on an inner side of the belt-fastening portion 21 at an outermost side of the buckle body 1. An insertion hole 14 for inserting a belt B is formed on an inner side of the belt-folding portion 22. The belt-mounting part is formed such that the length of the belt B can be adjusted.

On the other hand, in the insertion body 2, a belt-fastening portion 21 for fastening the belt B is provided at an outermost end of the insertion body 2 between both side frames 20. Further, a belt-folding portion 22 for catching and folding the belt B is formed on an inner side of the belt-fastening portion 21 of the insertion body 2 A base portion 23 extends between the side frames 20 on an inner side of the belt-folding portion 22 and the belt passage 24.

The belt-fastening portion 21 has a reversed bucket-like cross section, and a tip end of the belt-fastening portion 21 opposed to the belt-folding portion 22 is formed to have an acute angle so that a fastening portion 32 is formed to fasten the belt B. The belt-folding portion 22 has a reversed triangle cross section, and a tip end edge 31 of the belt-folding portion 22 opposed to the base portion 23 is formed to have an acute angle. Further, ridges 33 in an appropriate shape are formed on a surface of the belt-folding portion 22 so as to prevent the belt B from slipping.

A pair of operating portions 25 project from opposite sides of an outer surface, i.e. on the surface opposite from the belt-folding portion 22 of the base portion 23, of the insertion body 2. A leg portion 26 which is a connecting portion of each operating portion 25 to the base portion 23 is formed thin so as to provide the operating portion 25 with flexibility. At a tip end of the leg portion 26, there is an expanded head portion 27 whose side surface is expanded and whose tip end is formed thin so that a hook-like engaging portion 28 capable of engaging the engaged portion 9 of the buckle body 1 is formed at boundary between the leg portion 26 and the expanded head portion 27. On an inner side of the operating portions 25, the pair of projection pieces 29 having at its center portion the insertion groove 30 project from the base portion 23, and each of the projection pieces 29 is formed to be higher in height and shorter in length than the operating portions 25.

Figure 6:
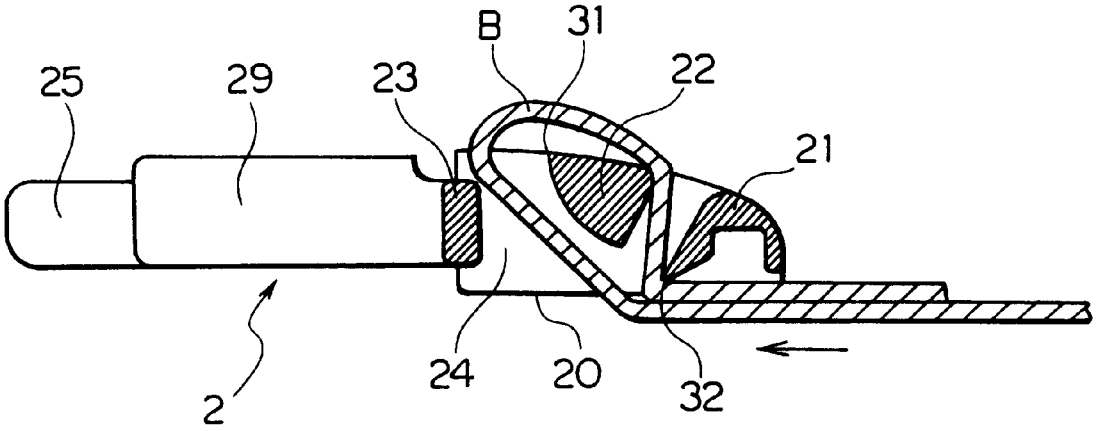
FIG. 6 is a sectional view of the buckle taken along a center of a longitudinal direction thereof, showing a belt-mounting state of the insertion body of the buckle.

In order to mount the belt B to the insertion body 2, the belt B is inserted from the lower surface of the insertion body 2 through the belt passage 24 in a direction of the arrow as shown in FIG. 6, and is bypassed and caught on the belt-folding portion 22. Then, the belt B is allowed to pass through the fastening portion 32 of the belt-fastening portion 21 and is pulled in the opposite direction of the arrow, thereby mounting the belt B to the insertion body 2. Like the insertion body 2, the buckle body 1 also allows the belt B to pass through the insertion hole 14 from a lower surface of the belt-mounting part 7, and then the belt B is caught on the belt-folding portion 22. Finally, the belt B is allowed to pass through the fastening portion 32 of the belt-fastening portion 21 to be bent and mounted.

Next, in order to insert the insertion body 2 into the buckle body 1 for engagement, the expanded head portions 27 of the operating portions 25 are made to abut against the side walls 5 of the insertion opening 6 of the buckle body 1 and are pushed, so that the operating portions 25 are flexed and inserted into the hollow portions 11. Further, the projection pieces 29 are inserted into the recessed grooves 12 formed in inner surface of the upper plate 3 of the buckle body 1, and at the same time, the projections 13 respectively formed on the inner surfaces of the upper plate 3 and the lower plate 4 are inserted into the insertion groove 30 of the insertion body 2 and guided. Thereafter, the buckle body 1 and the insertion body 2 are locked with each other in such a manner that the expanded head portions 27 of the operating portions 25 project from the opening portions 8, and the engaging portions 28 and the engaged portions 9 are engaged with each other.

In order to detach the insertion body 2 from the buckle body 1, the expanded head portions 27 of the operating portions 25 are firstly pushed inward and flexed, so that the engagement between the engaging portions 28 and the engaged portions 9 is released. Then, the expanded head portion s27 automatically escapes along the side walls 5 which open wider at a side of the insertion opening 6, thus the buckle body 1 and the insertion body 2 are detached and separated from each other.

Figure 7:
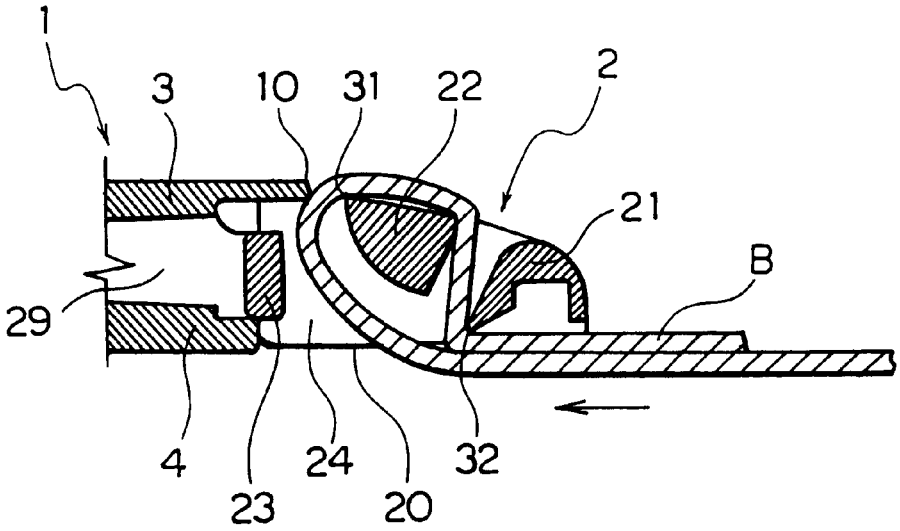
FIG. 7 is a sectional view of the buckle taken along the center of he longitudinal direction thereof, showing a belt mounting state when the buckle body and the insertion body are engaged with each other.

When the belt B loosens in a state in which the buckle body 1 and the insertion body 2 are engaged with each other, for example, when the belt B passing underneath the insertion body 2 moves in the direction of the arrow and loosens as shown in FIG. 7, the belt B loosens in a range between the projection 10 of the upper plate 3 and the tip end edge 31 of the belt-folding portion 22. Because of the existence of the projection 10, the loosening of the belt B on the upper surface of the belt-folding portion 22 can be reduced, so that the belt B is prevented from loosing by the projection 10.

When a user desires to loose the belt in the state in which the buckle body 1 and the insertion body 2 are engaged with each other, for example, if the insertion body 2 is lifted up in the direction of the arrow as shown in FIG. 5 about an end of the belt-mounting part 7 of the buckle body 1 as a fulcrum, the belt B assumes a parallel state between the belt-fastening portion 21 and the belt-folding portion 22. In other words, if the belt B is not bent by the fastening portion 32 of the belt-fastening portion 21 but is disposed straightly, the belt B loosens by itself. When the user desires to tighten the belt B, if the end of the upper belt B is pulled in a state in which the insertion body 2 is lifted up as described above, it is possible to easily tighten the belt B.

Figure 8:
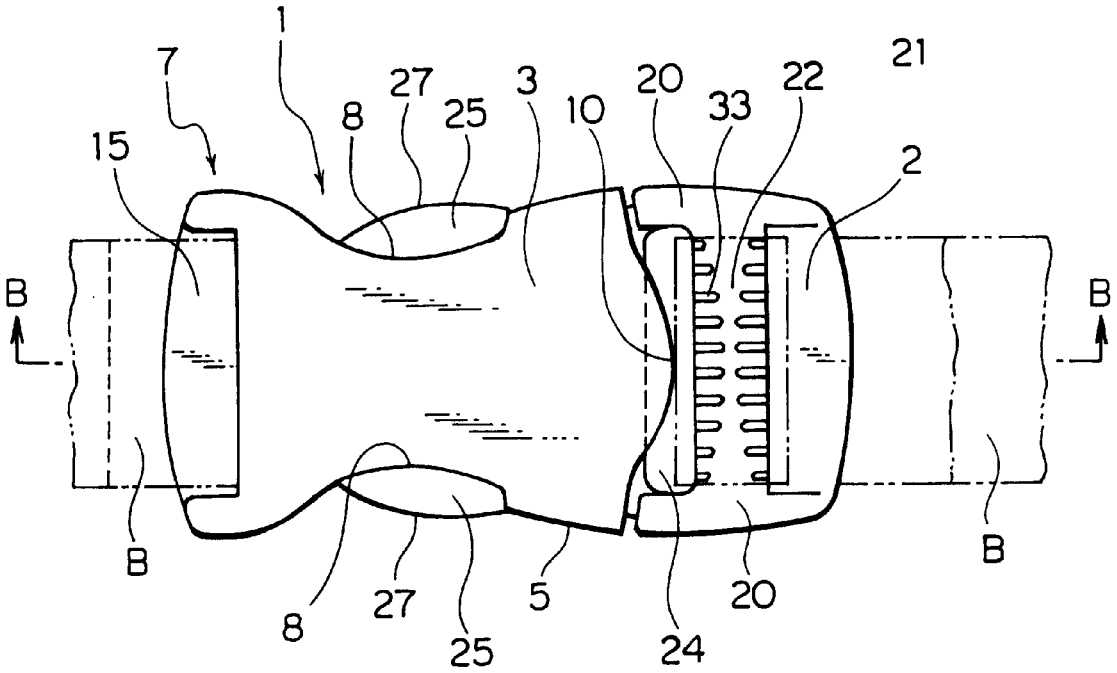
FIG. 8 is a plan view showing a buckle according to a second embodiment of the invention in a state in which a buckle body and an insertion body of the buckle are engaged with each other.
Figure 9:
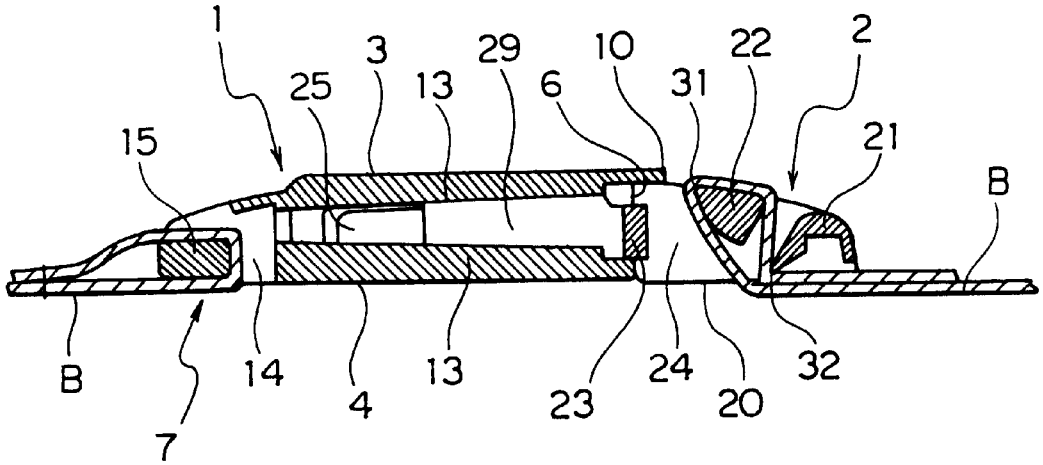
FIG. 9 is a sectional view of the buckle taken along the line B—B in FIG. 8.
Figure 10:
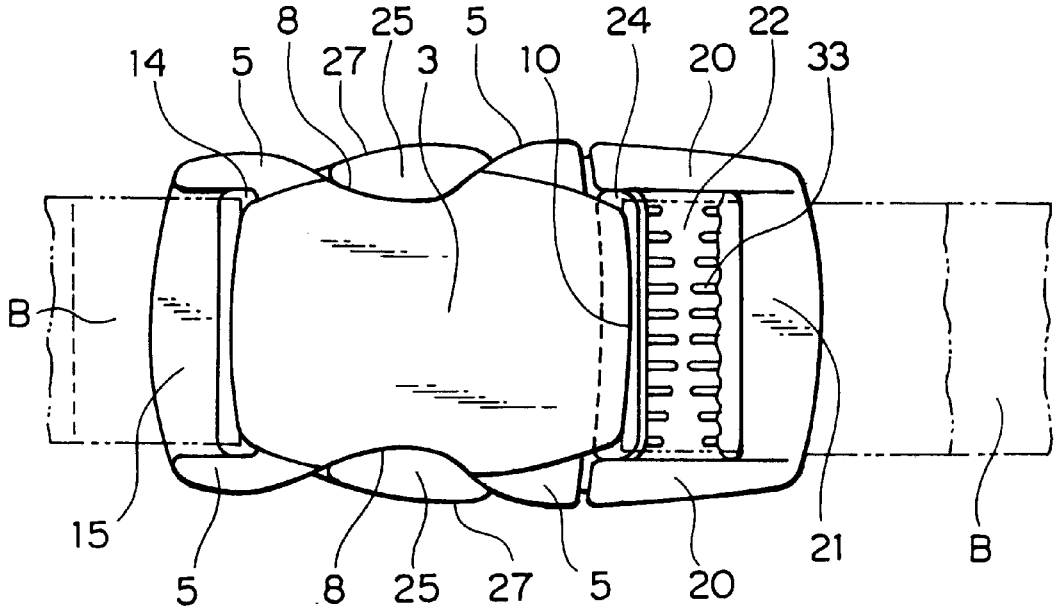
FIG. 10 is a plan view showing a buckle according to a third embodiment of the invention in a state in which a buckle body and an insertion body of the buckle are engaged.

A buckle according to a second embodiment of the invention as shown in FIGS. 8 and 9 is identical with that of the first embodiment except for the shape of the belt-mounting part 7 of the buckle body 1. In the belt-mounting part 7, a belt-mounting portion 15 having a rectangular cross section is provided extending between both side walls 5 at an outermost end of the buckle body 1, and the insertion hole 14 through which the belt B is inserted is provided on an inner side of the belt-mounting portion 15. An end of the upper plate 3 is formed so as to cover a part of the insertion hole 14. The belt B is wound around the belt-mounting portion 15 from underneath, and an end of the belt B is sewn so that the belt B is mounted to the buckle body 1. The buckle is used in the same manner as in the first embodiment.

A buckle according to a third embodiment of the invention shown in FIGS. 10 to 13 is flat cylindrical in shape, in which the buckle body 1 comprises an upper plate 3, a lower plate 4 and side walls 5. The buckle body 1 has at its one end an insertion opening 6, and at its other end a belt-mounting part 7. Each of the opposite side walls 5 has an opening portion 8 which is cut into an arc shape. The upper plate 3 has, at its portion closer to the insertion opening 6, a projection 10 totally projecting further than an edge of the lower plate 4 and being in parallel thereto. The projecting amount of the projection 10 is set such that the projection 10 projects above the belt passage 24 between the belt-folding portion 22 and a base portion 23 of the insertion body 2 so as to prevent the belt B from loosening and expanding when the insertion body 2 is inserted to the buckle body 1.

Figure 11:
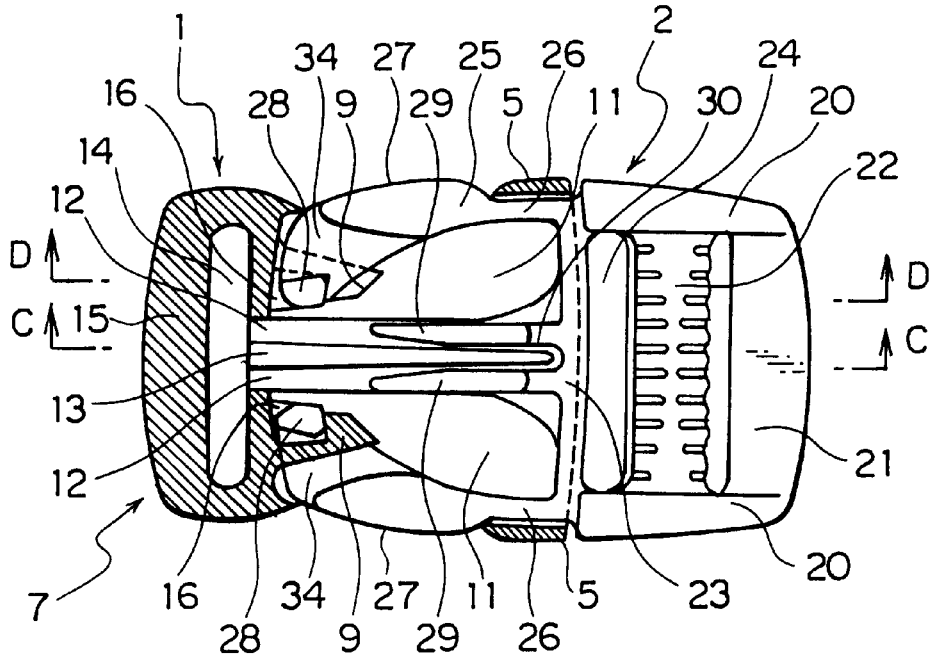
FIG. 11 is a plan view of the buckle when the buckle body and the insertion body are engaged with each other, with a part of the buckle body cut away.
Figure 12:
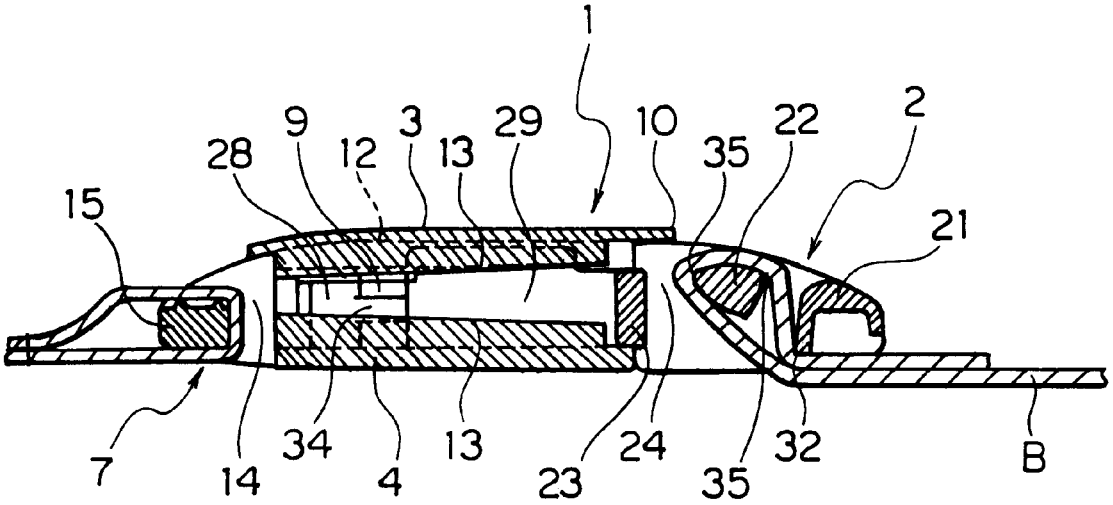
FIG. 12 is a sectional view taken along the line C-C in FIG. 11.

As shown in FIG. 11, in the buckle body 1, the upper plate 3 and lower plate 4 respectively have ridge portions 13 rising in confrontation with each other and extending centrally in a longitudinal direction of the upper plate 3 and the lower plate 4, and inserted into the insertion groove 30 between a pair of the projection pieces 29 of the insertion body 2. Deeply recessed grooves 12 for guiding the projection pieces 29 are formed on opposite sides of the ridge portion 13, and wide hollow portions 11 which are shallower than the recessed grooves 12 and in which the operating portions 25 are to slide and swing are formed on opposite sides of the recessed grooves 12. A pair of hook-like engaged portions 9 projecting toward the recessed grooves 12 are formed at a side of a belt-mounting part 7 opposing to the hollow portions 11. The engaged portions 9 are formed such that they can engage with the engaging portions 28 formed at tip ends of the operating portions 25 of the insertion body 2. The belt-mounting part 7 has a belt-mounting portion 15 having a rectangular cross section extending between terminal ends of opposite side walls 5 of the buckle body 1, and one end of the belt B is wound around the belt-mounting portion 15 and sewn to be fixed. The lower plate 4 has core holes 16 for molding the hook-like engaged portions 9.

Figure 13:
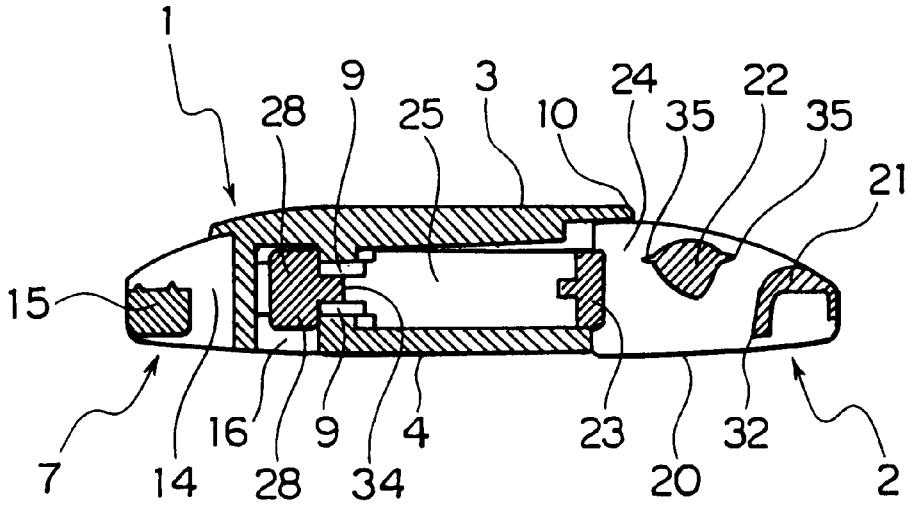
FIG. 13 is a sectional view taken along the line D-D in FIG. 11.
Figure 14:
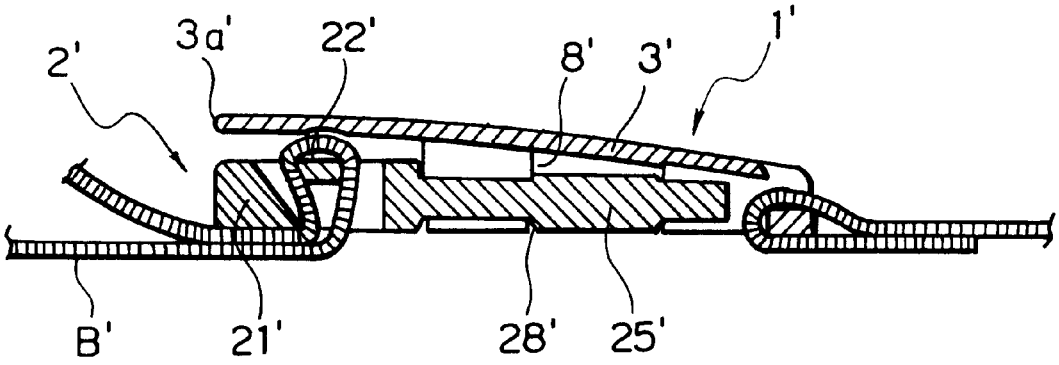
FIG. 14 PRIOR ART
FIG. 14 is a sectional view of a conventional buckle comprising a buckle body and an insertion body.
Figure 15:
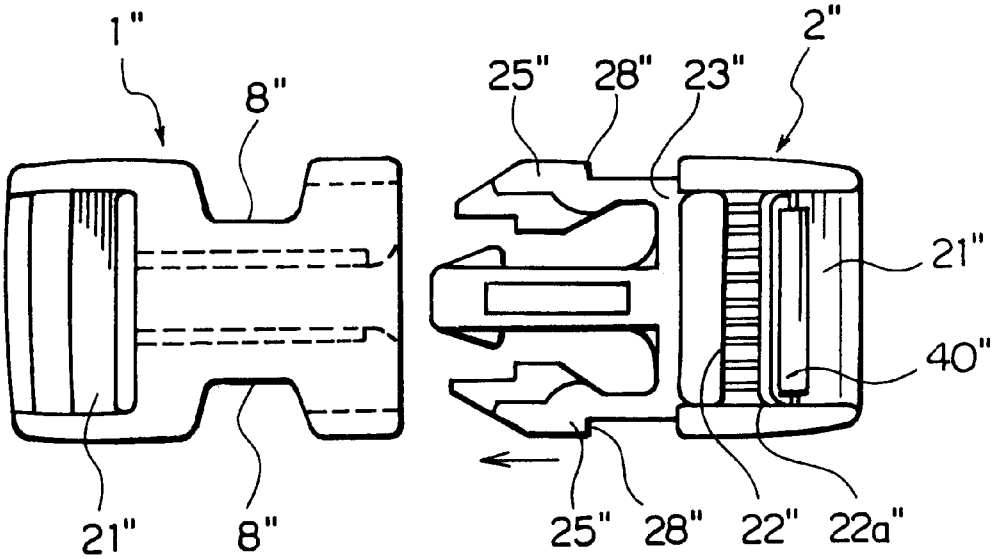
FIG. 15 PRIOR ART
FIG. 15 is a plan view of another conventional buckle comprising a buckle body and an insertion body.

As shown in FIG. 13, in the insertion body 2, a belt-fastening portion 21 for fastening the belt B to an outer side of its one end extends between both side frames 20, and the belt-folding portion 22 for catching and folding the belt B is provided on an inner side of the belt-fastening portion 21. The base portion 23 is provided extending between the side frames 20 on an inner side of the belt-folding portion 22 via the belt passage 24. The belt-fastening portion 21 has a reversed bucket-like cross section, and has one end of an acute angle as a fastening portion 32 to fasten the belt B. The belt-folding portion 22 has a substantially fan-like cross section and has at its front and rear portions V-shaped projections 35 arranged in a staggered manner for preventing the belt B from slipping.

As shown in FIG. 11, the insertion body 2 has the operating portions 25 projecting from opposite sides of an outer surface, i.e. on the surface opposite from the belt-folding portion 22, of the base portion 23 of the insertion body 2. Each of the operating portions 25 has a leg portion 26 which is a connecting portion to the base portion 23. The leg portion 26 is formed thin to provide the operating portion 25 with flexibility. The leg portion 26 has at its tip end an expanded head portion 27 projecting toward the opening portion 8 of the buckle body 1, and the expanded head portion 27 has at its tip end an extending portion 34 which is a plate thinner than the expanded head portion 27 and curving inward. Small projecting engaging portions 28 are formed on upper and lower surfaces of inner tip ends of the pair of extending portions 34 so that the engaging portions 28 can engage with the hook-like engaged portions 9 of the buckle body 1.

Mounting of the belt B to the insertion body 2 and adjustment of its length may be carried out by the same means as that of the buckle of the first embodiment. The insertion body 2 is engaged with the buckle body 1 such that the operating portions 25 of the insertion body 2 are first flexed inwardly along the side walls 5 of the buckle body 1 and inserted, and at the same time, the engaging portions 28 provided on the extending portions 34 are guided by the outer surfaces of the hook like engaged portions 9 and inserted, and then, the expanded head portions 27 project out of the opening portions 8 and at the same time, the engaging portions 28 engage with the engaged portions 9. Then, the buckle body 1 and the insertion body 2 are engaged with each other. At that time, the pair of projection pieces 29 are guided by the recessed grooves 12 and the ridge portions 13, and are appropriately engaged without side wobbling.

The insertion body 2 is detached from the buckle body 1 such that the expanded head portions 27 of the operating portions 25 exposed from the opening portions 8 of the buckle body 1 are pushed from both sides, the engaging portions 28 on the extending portions 34 of the operating portions 25 are detached from the hook-like engaged portions 9, and then, the expanded head portions 27 are pushed into both the side walls 5, thereby detaching the insertion body 2 from the buckle body 1.

The present invention has the structures mentioned above, and the following effects can be achieved by these structures.

In the present invention, according to the present invention, there is provided a buckle comprising: a flat buckle body 1 including an upper plate 3, a lower plate 4 and both side walls 5, an insertion opening 6 at one end of the buckle body 1, a belt-mounting part 7 at the other end of the buckle body 1, opening portions 8 at the side walls 5, and engaged portions 9; an insertion body 2 including a belt-fastening portion 21 at one end of the insertion body 2, a belt-folding portion 22 on an inner side of the belt-fastening portion 21, a belt passage 24 on an inner side of the belt-folding portion 22, and a base portion 23 on an inner side of the belt passage 24, the insertion body 2 further including flexible operating portions 25 projecting from opposite sides of the base portion 23 toward the belt-mounting part 7 of the buckle body 1 and having engaging portions 28, wherein the buckle body 1 further includes a projection 10 formed on the upper plate 3 of the insertion opening 6 so as to further project than the lower plate 4 and to project above the belt passage 24 of the insertion body 2 at the time of engagement of the buckle body 1 and the insertion body 2 so that a belt B wound around the belt-folding portion 22 is prevented from loosening. With this feature, the belt B is prevented from expanding and loosening excessively within the buckle when the buckle is used, the fastening state of the belt B can be checked visually thus can be adjusted in a simple manner even when the buckle body 1 and the insertion body 2 are engaged with each other, and the belt B can easily be prevented from loosening with a simple structure.

Further, since the projection 10 formed on the upper plate 3 of the buckle body 1 is formed into an arc shape whose center portion projects most, it is possible to prevent the belt B from loosening at the center of the buckle, and to easily adjust the length of the belt B at opposite sides of the buckle.

Furthermore, since the projection 10 formed on the upper plate 3 of the buckle body 1 is formed so as to totally project in parallel to an end of the lower plate 4, the belt B can reliably be prevented from loosening uniformly over the entire width of the buckle without displacing in the lateral direction.

Still further, since the projection 10 formed on the upper plate 3 of the buckle body 1 is formed so as to project toward a tip end edge 31 of the belt-folding portion 22 of the insertion body 2 at the time of the engagement, the belt B can be prevented from loosening more appropriately and efficiently.

Still further, according to the present invention, the engaging portions 28 are respectively formed on outer surfaces of the operating portions 25 projecting from the base portion 23 of the insertion body 2, and the engaged portions 9 to be engaged with the engaging portions 28 are respectively formed on one-side ends of the opening portions 8 formed at the side walls 5 of the buckle body 1, so that the buckle body 1 and the insertion body 2 can be engaged with/disengaged from each other. Or alternatively, the engaging portions 28 are respectively formed on upper and lower surfaces of tip ends of the operating portions 25 projecting from the base portion 23 of the insertion body 2, and the engaged portions 9 to be engaged with the engaging portions 28 are respectively formed on inner surfaces of the upper plate 3 and the lower plate 4 of the buckle body 1, so that the buckle body 1 and the insertion body 2 can be engaged with/disengaged from each other. With this feature, even when the buckle body 1 and insertion body 2 are different in type, a mechanism for preventing the belt B from loosening and a mechanism of adjusting the length of the belt B by checking its length visually can easily be applied.

What is claimed:

1. A buckle comprising:

(a) a buckle body including an upper plate, a lower plate and both side walls, an insertion opening at one end of the buckle body, a belt-mounting part at the other end of the buckle body, opening portions at the side walls, and engaged portions;

(b) an insertion body including a belt-fastening portion at one end of the insertion body, a belt-folding portion on an inner side of the belt-fastening portion, a belt passage on an inner side of the belt-folding portion, and a base portion on an inner side of the belt passage, the insertion body further including flexible operating portions projecting from opposite sides of the base portion toward the belt-mounting part of the buckle body and having engaging portions, wherein the buckle body further includes a projection formed on the upper plate of the insertion opening so as to further project than the lower plate and to project above the belt passage of the insertion body without completely covering the belt passage at the time of engagement of the buckle body and the insertion body so that a belt wound around the belt-folding portion is prevented from loosening.

2. A buckle according to claim 1, wherein the projection formed on the upper plate of the buckle body is formed into an arc shape whose center portion projects most.

3. A buckle according to claim 1, wherein the projection formed on the upper plate of the buckle body is formed so as to totally project in parallel to an end of the lower plate.

4. A buckle according to claim 1, 2 or 3, wherein the projection formed on the upper plate of the buckle body is formed so as to project toward a tip end edge of the belt-folding portion of the insertion body at the time of the engagement.

5. A buckle according to claim 4, wherein the engaging portions are respectively formed on outer surfaces of the operating portions projecting from the base portion of the insertion body, and the engaged portions to be engaged with the engaging portions are respectively formed on one-side ends of the opening portions formed at the side walls of the buckle body, so that the buckle body and the insertion body can be engaged with/disengaged from each other.

6. A buckle according to claim 4, wherein the engaging portions are respectively formed on upper and lower surfaces of tip ends of the operating portions projecting from the base portion of the insertion body, and the engaged portions to be engaged with the engaging portions are respectively formed on inner surfaces of the upper plate and the lower plate of the buckle body, so that the buckle body and the insertion body can be engaged with/disengaged from each other.

* * * * *